US006434870B1

(12) United States Patent
Fanjoy

(10) Patent No.: US 6,434,870 B1
(45) Date of Patent: Aug. 20, 2002

(54) METHOD OF PERSONALIZING MESSAGE TAGS FOR FOOTWEAR

(76) Inventor: Jennifer M. Fanjoy, 509 N. Glen Dr., Raleigh, NC (US) 27609

( * ) Notice: Subject to any disclaimer, the term of this patent is extended or adjusted under 35 U.S.C. 154(b) by 20 days.

(21) Appl. No.: 09/617,014

(22) Filed: Jul. 14, 2000

Related U.S. Application Data

(60) Provisional application No. 60/148,571, filed on Aug. 13, 1999.

(51) Int. Cl.[7] ..... G09F 23/00
(52) U.S. Cl. ..... 40/636
(58) Field of Search ..... 40/636, 616, 631, 40/633, 673; 24/3.6; D20/24; 2/245; 116/200, DIG. 41; 36/112, 136, 56

(56) References Cited

U.S. PATENT DOCUMENTS

| | | | | | |
|---|---|---|---|---|---|
| 1,462,220 | A | * | 6/1923 | Wiegandt | 40/673 |
| 2,095,869 | A | | 10/1937 | Hermson | |
| 2,248,145 | A | * | 7/1941 | Wilder | 40/673 X |
| 2,298,364 | A | * | 10/1942 | Gits et al. | 40/616 |
| 2,871,537 | A | | 2/1959 | Hickerson | |
| 4,254,566 | A | | 3/1981 | Haskell | 40/2 |
| 4,536,975 | A | | 8/1985 | Harrell | 36/136 |
| 4,539,767 | A | * | 9/1985 | Jaffe | 40/673 X |
| 4,630,383 | A | | 12/1986 | Gamm | 36/136 |
| 5,209,000 | A | | 5/1993 | Rowland et al. | 36/136 |
| 5,380,046 | A | | 1/1995 | Stephens | 283/75 |
| 5,381,617 | A | * | 1/1995 | Schwartztol et al. | 40/6 |
| D356,599 | S | * | 3/1995 | Ashner | D20/27 |
| 5,596,821 | A | | 1/1997 | Solo | 36/136 |
| 5,845,422 | A | | 12/1998 | Valteau | 36/136 |
| D404,770 | S | * | 1/1999 | Mead et al. | D20/24 |
| D406,177 | S | * | 2/1999 | Milroy | D20/27 |

* cited by examiner

*Primary Examiner*—Joseph D. Pape
*Assistant Examiner*—Jason Morrow
(74) *Attorney, Agent, or Firm*—Mills Law Firm PLLC

(57) ABSTRACT

A personalized message tag attached to the laces of a shoe bearing on the front visible surface the introductory portion of a desired phrase and having a non-visible rear surface that the wearer can inscribe a completing portion the desired phrase. The tags are provided with a discrete color for each separate introductory portion of the desired phrase.

3 Claims, 1 Drawing Sheet

METHOD OF PERSONALIZING MESSAGE TAGS FOR FOOTWEAR

RELATED APPLICATIONS

The present application claims the benefit under 35 USC 120 of U.S. Provisional Application No. 06/148,571 filed on Aug. 13, 1999 in the name of Jennifer M. Fanjoy and entitled "Message Tags for Footwear".

FIELD OF THE INVENTION

The present invention relates to message tags for footwear and, in particular, to a color coordinated message tag for attachment to footwear that carries a preprinted beginning part of a message on the visible side and an writing surface on the non-visible side for completion of the concluding part of the message by the wearer.

BACKGROUND OF THE INVENTION

Identification or other purpose tags connected to shoe laces have been utilized over the years. Typically, these tags have been used to inscribe identification information on one side of the tag. Other types of tags are used for storage of items such as keys, money and the like during user activities such as running, walking, or exercise. Such tags have taken a standardized prescribed format for allowing the user to write a specific information, but have not differentiated between different message types or meanings of expressions.

For instance, U.S. Pat. No. 2,871,537 to Hickerson discloses a flip-up tab to attachment to the upper shoe laces. The attachment carries on an interior non-visible and non-accessible surface address information regarding the wearer. The tag is color coordinated with the shoe.

U.S. Pat. No. 4,254,566 to Haskell discloses a jogging or running shoe having a flexible foldable sheet bearing personal information regarding the wearer. The sheet is disposed between the laces and tongue of the shoe.

U.S. Pat. No. 4,536,975 to Harrell discloses a pocket for carrying identification cards, photos, coins, keys, tickets and the like. The pocket is attached to the lower shoelaces and has a button fastener for maintaining the pocket in overlying relationship on the shoelaces.

U.S. Pat. No. 5,209,000 to Rowland et al. discloses a decorative lace covering for shoes bearing decorative, non-personalized indicia on the visible surface thereof.

U.S. Pat. No. 2,095,869 to Hermson discloses a shoe tab having numbered indicia on the visible surface thereof and fixedly laced into the lower laces.

U.S. Pat. No. 5,845,422 to Valteau discloses a decorative attachment for footwear having a front surface bearing decorative indicia and fixedly secured in place at a plurality of shoelace loops.

U.S. Pat. No. 5,380,046 to Stephens discloses a sealed packet for attachment to the wearer that may be destructively opened for accessing personal information regarding the user.

U.S. Pat. No. 5,596,821 to Solo discloses a utility article attachable to footwear having a plurality of buttoned pockets for storing personal articles of the user.

U.S. Pat. No. 4,630,383 to Gamm discloses a zippered closure for carrying personal articles of the wearer and attachable with the laces of the shoe.

As will be appreciated, the foregoing provide prescribed formats for user information. In general, only identifying information for enabling return of goods or emergency information in case assistance is required on provided in such approaches. Where ancillary information is possible, the same is contained within secure enclosures as part of a carriage vehicle for other primary items such as money, keys and the like. None provide the opportunity for the wearer to present decorative formats that may be personalized by the wearer. Further, such tags are primarily directed at the adult exercising population and have limited appeal for younger people including children.

Accordingly, it is an object of the invention to provide a message tag for footwear that bears a decorative introductory phrase on a visible surface and a completing phrase on the non-visible surface.

A further object of the invention is to provide a decorative shoelace tag for children's shoes having a color coordinated starting phrase on the front surface and an ending phrase completed by the wearer on the rear surface.

Another object of the invention is to provide a shoe tag that is available in an array of colors for attachment to the laces of a wearers shoe having a preprinted phrase on the public surface that is completed and personalized on the private surface by the wearer.

Yet another object of the invention is to provide a method of providing personalized tags for shoes wherein a plurality of tags in varying colors, sizes and shapes are provided with a variety of introductory phrases on a front surface that are completed by the user's inscribing a completing phrase on the rear surface.

BRIEF SUMMARY OF THE INVENTION

The foregoing objects and advantages are provided in the present invention by a shoe lace tag that is attachable to the shoelaces of the wearer's shoe. The shoe tag may be selected from an inventory of various colors and shapes. Each shoe tag has a front, public surface containing an preprinted introductory phrase of interest to the wearer. The rear, non-public surface of the tag overlying the laces may be completed by or on behalf of the wearer with a concluding phrase in a personalized manner. Accordingly, younger children for instance may select a color and a phrase for their shoes. In public, the phrase will promote interest and query by observers as to the nature of the concluding phrase. Only by exposing, the non-public rear surface will the observer uncover the answer to the phrase. Accordingly, the interaction between wearer and friends will be enhanced through such queries while providing a stylish addition to the footwear.

DESCRIPTION OF THE DRAWINGS

The above and other features, objects and advantages of the present invention will become apparent upon reading the following detailed description taken in conjunction with the accompanying drawings in which.

DETAILED DESCRIPTION OF THE PREFERRED EMBODIMENTS

Figure 1:
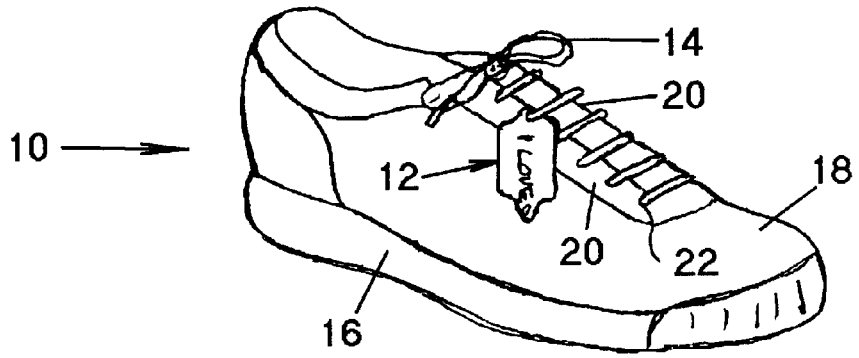
FIG. 1 is a perspective view of a shoe having a personal shoe tag in accordance with the present invention.

Referring to the drawings for the purposes of describing the preferred embodiments only and not for limiting same, FIG. 1 illustrates a children's shoe 10 having a personalized message tag 12, containing a personalized phrase or statement, attached the shoe laces 14 adjacent the upper ends thereof. While hereinafter described with reference to children's shoes, it will become apparent that the present invention may be applied to footwear in general, everyday footwear or special purpose footwear, without regard to the age or gender of the wearer.

Figure 2:
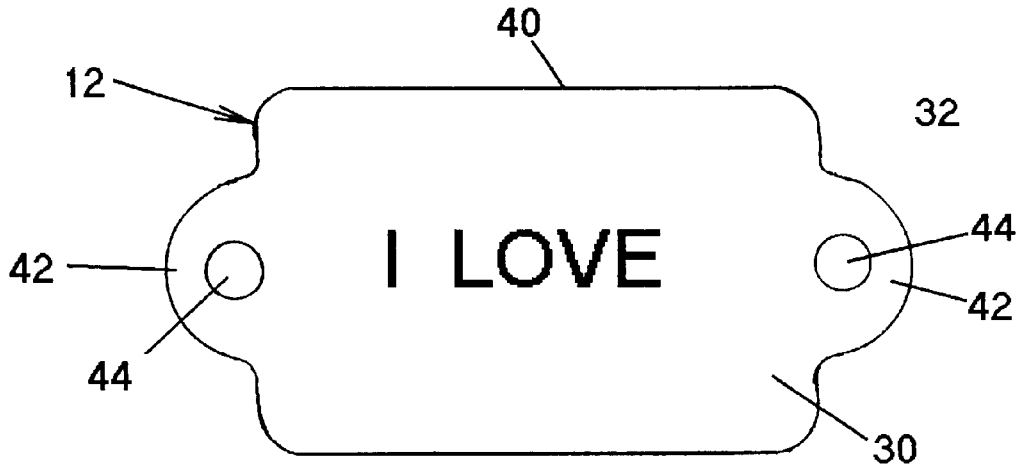
FIG. 2 is a front view of the shoe tag shown in FIG. 1.
Figure 3:
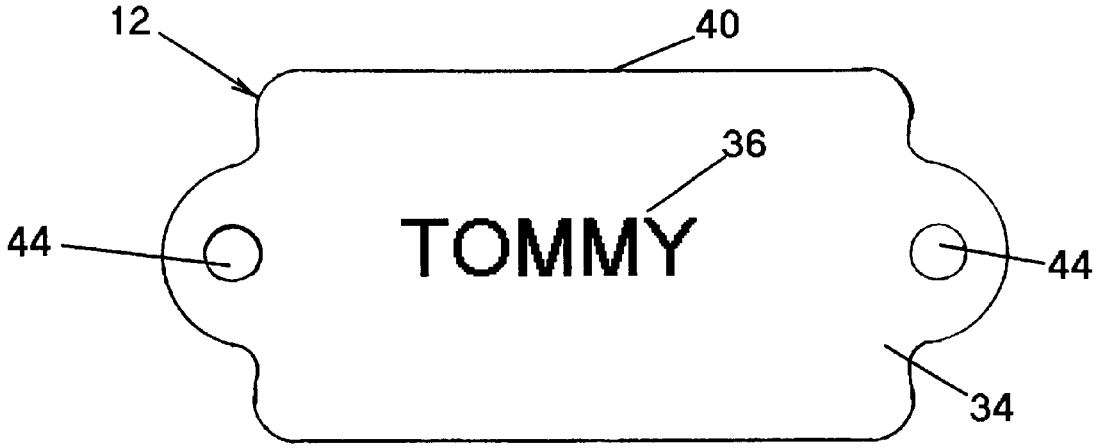
FIG. 3 is a rear view of the shoe tag shown in FIG. 2.

More particularly, the shoe 10 comprises a sole 16 an instep 18 and a pair of inwardly converging flaps 20. The flaps 20 are provided with rows of eyelets 22 through which the shoe lace 14 is threaded in a conventional manner and tied adjacent the upper eyelets. The message tag 12 is illustrated attached adjacent the upper end of the lace 14, however it will be apparent that the tag may be attached at varying locations depending on the preferences of the wearer. As viewed by the user-and as shown additionally in FIGS. 2 and 3, the tag 12 has a front, visible and public surface 30 bearing a pre-labeled introductory phrase 32 and a rear, non-visible private surface 34 bearing a wearer completed concluding phrase 36. Typically, the introductory phrase 32 will include a pronoun or subjects and a verb while the concluding phrase 36 will be an identifying object for a personal statement such. as "I LOVE" on the front public surface 30 and "TOMMY" on the private rear surface 36. Accordingly, friends and observers can determine the complete phrase, "I LOVE TOMMY" only by the cooperation of the wearer.

The message tag 12 may be formed in a variety of sizes, shapes and colors of interest to classes of shoe wearers. Preferably the tags are formed of a laminated material having a suitable front surface for bearing a printed, embossed or otherwise preformed introductory phrase, and a rear surface suitable for writing the concluding phrase by an appropriate, preferably indelible, writing instrument.

As illustrated, the tag 12 has a generally rectangular body 40 having lateral ears 42 with eyelets 44. According, the tag will hang vertically from one eyelet 44 and the introductory phase 32 is inscribed longitudinally, or if desired laterally. Additionally, both eyelets may be used for mounting the tag laterally across the shoelace with the with the introductory phase clearly visible to observers when appearing longitudinally.

The tags may be formed of any thus suitable material such as plastic, leather or suitable front surface material and a rear surface of the same or suitable surface properties for personalizing by the wearer.

The shape of the body of the tag may also be varied in accordance with the preferences of the wearer and may be textured, embossed, colored or otherwise stylishly emboldened as desired.

Particularly for younger wearers, the tags may be selected from an inventory of various colors. Each tag color may be provided with a different preprinted message. For instance, all red tags could have the message "I Love", white tags could have the message "I Like", yellow tags could have the message "I Miss" and so forth for a number of different color corresponding messages.

The wearer would then select a colored tag with the introductory message they would like displayed for the phrase they wish to express. The wearer would then write the ending phrase such as "Tommy" or "My Dog" on the rear private side. The wearer would then attach the tag 12 to their shoelace 14 by threading the lace through the eyelet or eyelets for displaying the front surface. Others would then know the wearer thinks something but would not know the answer unless the tag was reversed. The same or different tags could be worn on both shoes or changed from time to time in accordance with the desires of the wearer.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A method of personalizing the shoes of a user comprising the steps of:

a. providing an inventory of shoe tags attachable to the shoes of a user;

b. allocating said inventory into classes of differing colors;

c. assigning a discrete introductory legend for each class of color;

d. providing said shoe tags with a front surface with an introductory legend in accordance with the color thereof;

e. providing a rear surface for the user to inscribe a concluding legend to thereby complete a phrase of the user's selection; and f. handwriting on said rear surface said concluding legend.

2. The method of personalizing the shoes of a user as recited in claim 1 wherein said phrase comprises a statement and the introductory legend consists of the subject and noun of said phrase.

3. The method of personalizing the shoes of a user as recited in claim 1 wherein said rear surface is suitable for inscription by means of a permanent marking material.

* * * * *